United States Patent [19]

Takahashi

[11] Patent Number: 4,968,163

[45] Date of Patent: Nov. 6, 1990

[54] HOT ZONE CONTROL OF AUTOMATIC LINE FEED

[75] Inventor: Tsutomu Takahashi, Kawasaki, Japan

[73] Assignee: Canon Kabushiki Kaisha, Tokyo, Japan

[21] Appl. No.: 501,330

[22] Filed: Mar. 22, 1990

Related U.S. Application Data

[63] Continuation of Ser. No. 188,148, Apr. 26, 1988, abandoned, which is a continuation of Ser. No. 929,494, Nov. 12, 1986, abandoned, which is a continuation of Ser. No. 688,432, Jan. 2, 1985, abandoned.

[30] Foreign Application Priority Data

Jan. 13, 1984 [JP] Japan ..... 59-3386

[51] Int. Cl.[5] ..... B41J 19/68

[52] U.S. Cl. ..... 400/315; 400/63; 400/279; 364/710.13

[58] Field of Search ..... 400/9, 7, 12, 298, 279, 400/313, 314, 314.1, 315, 316, 63, 64; 340/724; 364/710.13

[56] References Cited

U.S. PATENT DOCUMENTS

| | | | |
|---|---|---|---|
| 3,023,876 | 3/1962 | Niccolls | 400/315 |
| 3,685,629 | 8/1972 | Rott | 400/314.1 |
| 3,915,278 | 10/1975 | Spence et al. | 400/63 |
| 3,968,868 | 7/1976 | Greer, Jr. et al. | 400/63 |
| 4,086,660 | 4/1978 | McBride | 400/63 |
| 4,244,031 | 1/1981 | Izushima et al. | 400/7 |
| 4,330,217 | 5/1982 | Churgovich et al. | 400/64 |
| 4,388,007 | 6/1983 | Meier et al. | 400/315 |
| 4,403,301 | 9/1983 | Fessel | 400/62 |
| 4,498,150 | 2/1985 | Gaudet et al. | 400/62 |

FOREIGN PATENT DOCUMENTS

| | | | |
|---|---|---|---|
| 77140 | 7/1978 | Japan | 400/314 |
| 142885 | 8/1983 | Japan | 400/316 |
| 181665 | 10/1983 | Japan | 400/63 |

OTHER PUBLICATIONS

Schaefer, "Automatic Carriage Return", IBM Technical Disclosure Bulletin, vol. 11, No. 3, p. 261, 8/68.

Berger et al., "Blank Hyphen Techniques", IBM Technical Disclosure Bulletin, vol. 17, No. 4, p. 961, 9/74.

*Primary Examiner*—Eugene H. Eickholt

*Attorney, Agent, or Firm*—Fitzpatrick, Cella, Harper & Scinto

[57] ABSTRACT

An information processing apparatus has a keyboard including a key for setting an automatic line feed/line return mode, a control device, a printer, and a memory. When a space input is detected in a preset hot zone, an automatic line feed/line return is made. When a space input immediately after an automatic line feed/line return is detected, the space input is cancelled and the printer waits for the next key input.

9 Claims, 2 Drawing Sheets

HOT ZONE CONTROL OF AUTOMATIC LINE FEED

This application is a continuation of application Serial No. 188,148 filed Apr. 26, 1988, now abandoned, which is a continuation of aplication Serial No. 929,494 filed Nov. 12, 1986, now abandoned, which is a continuation of application Serial No. 688,432 filed Jan. 2, 1985, now abandoned.

BACKGROUND OF THE INVENTION

1. Field of the Invention

The present invention relates to an information processing apparatus such as an electronic typewriter which has an automatic return function (line return/line feed function ) of a carriage.

2. Description of the Prior Art

In a conventional mechanical or electric typewriter, the carriage is returned by depressing the return key for each line. However, with the advent of information processing apparatuses such as an electronic typewriter which is electronically controlled by a microprocessor, an automatic line feed/line return function is provided. With this function, a line feed and a line return are automatically performed upon depression of a space key, in a hot zone set near the right margin. With this type of apparatus, the operator need not pay attention to the end of each line at the right margin and can keep operating keys without having to depress the return key, except in the case of a new paragraph.

However, in an electronic typewriter of this type, two spaces must be inputted after a period. When the space key is depressed once after a period in the hot zone, an automatic line feed/line return is made and the second depression of the space key results in a blank space at the begining of the next line. In order to prevent this from occurring, the operator must check if an automatic line feed/line return has been made upon the first depression of the space key after inputting a period. For this reason in this situation, the advantage of allowing the operator to continue typing without having to consider the right margin is negated.

SUMMARY OF THE INVENTION

It is an object of the present invention to provide an information processing apparatus which can fully utilize the advantage of an automatic line feed/line return function and which does not allow a blank space to be left at the beginning of a new line when the space key is depressed twice after a period at the end of a prior line.

It is another object of the present invention to provide an information processing apparatus comprising input means for inputting characters and spaces, setting means for setting an automatic line feed mode, discriminating means for discriminating if a space input is made in a preset hot zone, memory means for storing that a space input is made in the hot zone when the discriminating means determines that the space input is made in the hot zone and when the setting means selects the automatic line feed mode, and cancelling means for cancelling another space input from the input means when the memory means stores that the space input is made in the hot zone.

DETAILED DESCRIPTION OF THE PREFERRED EMBODIMENT

Figure 1:
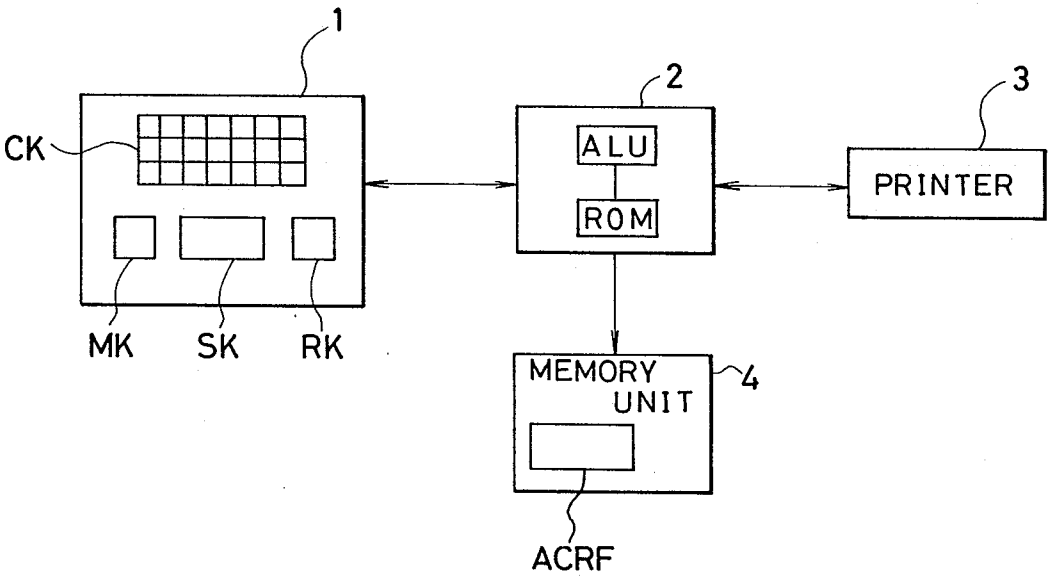
FIG. 1 is a block diagram showing the system configuration of an electronic typewriter according to an embodiment of the present invention.

FIG. 1 shows the system configuration of an electronic typewriter according to an embodiment of the present invention. A keyboard 1 has character/symbol keys CK, a space key SK, a carriage return key RK, and a mode setting key MK for setting the automatic line feed/line return mode. When any of these keys of the keyboard 1 is depressed, a corresponding key signal is supplied to a control device 2 so as to drive a printer 3. The printer 3 drives a carriage and prints characters and symbols in accordance with key input at the keyboard 1. A memory unit 4 stores various pointers and flags including a flag ACRF which is set upon a key input immediately after an automatic line feed/line return to be described later.

Figure 2:
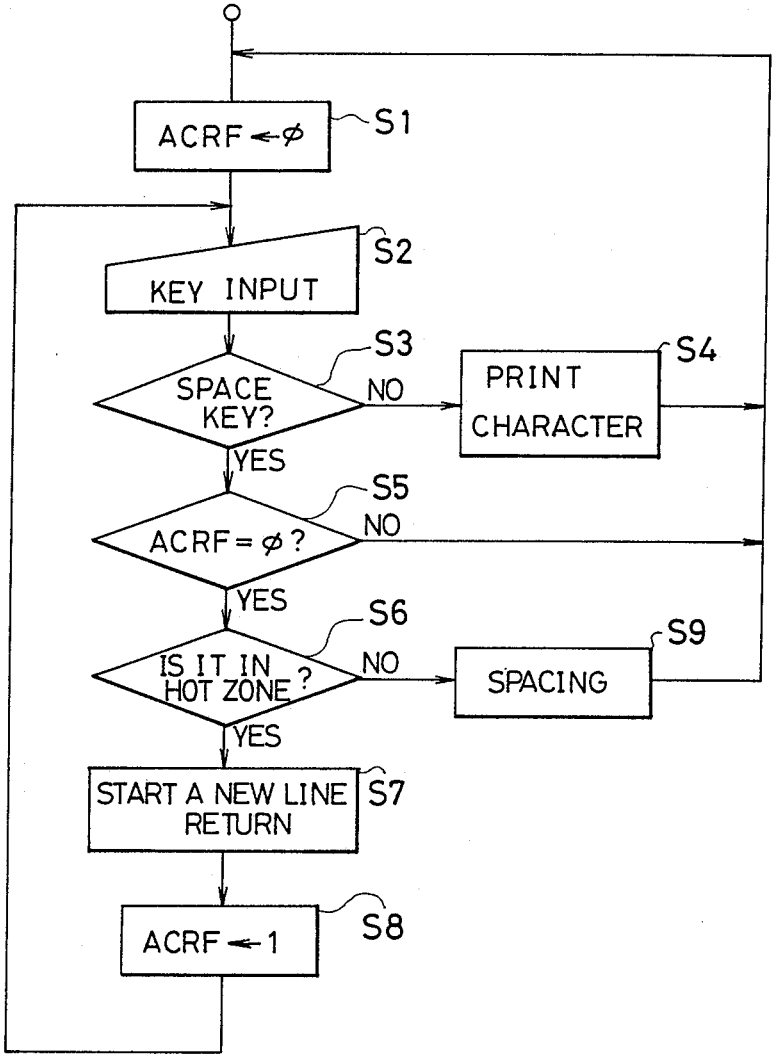
FIG. 2 is a flow chart showing the control sequence when a space key is depressed in a control device of the typewriter shown in FIG. 1.

The control device 2 comprising a microprocessor has a memory ROM storing a program of an algorithm shown in FIG. 2 and an ALU. The control device 2 controls the operation of the printer 3 in accordance with a key input from the keyboard 1, and also controls the read/write operation of various data into/from the memory unit 4. When the setting key MK of the keyboard 1 is depressed, the control device 2 detects if a space key input is made in a hot zone. If so, the carriage of the printer 3 automatically starts a new line and returns to the left margin. When the setting key MK is depressed and a space key input immediately after an automatic line feed/line return is detected, the space input is not effected despite the input signal.

FIG. 2 shows an example of a control sequence in the control device 2 for prohibiting a space input immediately after an automatic line feed/line return in the automatic line feed/line return mode. This control sequence corresponds to the case wherein a space key input immediately after an automatic line feed/line return in an electronic typewriter is cancelled and will not be supplied to the printer 3.

In step S1, the flag ACRF is set at logic "0". The flag ACRF is used to indicate if a key input is a first key input immediately after an automatic line feed/line return. As will be described in steps S7 and S8, the flag ACRF is set at logic "1" only in the case of a first key input after an automatic line feed/line return.

In the state wherein the flag ACRF is set at "0" level, a key input is received in step S2. It is checked in step S3 if the key input is a space input. If NO in step S3, the flow advances to step S4 and an input character or symbol is printed. However if YES in step S3, the flow advances to step S5. It is then checked in step S5 if the flag ACRF is set at logic "0". If YES in step S5, the flow advances to step S6 and it is checked if the key input is made in a hot zone. If YES in step S6, the flow advances to step S7 to start a new line and a carriage return is performed. In step S8, the flag ACRF is set at logic "1". However, if the flag ACRF is set at logic "0" in step S5 and the key input is not in the hot zone in step S6, the flow advances to step S9 and a space is printed. After step S9, the flow returns to step S1 to await the next key input. In this manner, according to the present invention, when the key input is determined to be a space input in step S3 and the flag ACRF is not set at logic "0" in step S5, the key input is determined to be a space input immediately after an automatic line feed/-line return. Therefore, the space input does not effect an automatic line feed/line return but effects a space printing.

As described above, according to the present invention, in a printer capable of an automatic line feed/line return upon depression of a space key in a hot zone set near the right margin, in the automatic line feed/line return mode, it is first checked if the key input is a first key input after an automatic line feed/line return. If it is determined that the key input is a first key input after an automatic line feed/line return, a space is not printed and the next key input is awaited. When an automatic line feed/ line return is made upon a first depression of a space key after a period, the next space input will not result in printing a space, and the next key input can be printed. Therefore, even if the operator depresses the space key twice after each period as in a conventional typewriter, a space will not be printed at the beginning of a line. The operator can operate the typewriter continuously without having to check if each space input is a first input after an automatic line feed/line return.

What is claimed is:

1. An information processing apparatus capable of providing an automatic line feed, said apparatus comprising:

input means for inputting characters and spaces;

discriminating means for discriminating if a space input through said input means is made in a hot zone;

automatic line feed means for causing an automatic line feed upon discrimination by said discriminating means of a first space input in the hot zone;

determining means for determining if the space input has been made immediately after the automatic line feed by said automatic line feed means;

cancelling means for cancelling spaces input subsequent to the first space input in the hot zone so that a space is not produced immediately after completion of an automatic line feed when it is determined by said determining means that a space input is input immediately after the automatic line feed; and output means connected to said cancelling means for outputting a character subsequent to the cancelled space inputs at a position of a beginning of a new line after completion of an automatic line feed.

2. An apparatus according to claim 1, wherein said input means includes a keyboard.

3. An apparatus according to claim 1, further comprising means for performing a line return to cause said input means to be operative to input characters and spaces at a said new line left margin of when said discriminating means discriminates that the space input is in the hot zone.

4. an apparatus according to claim 3, wherein said line return performing means also performs a line feed for causing said input means to be operative to input characters and spaces at a left margin of said new line.

5. Electronic equipment comprising:

input means for inputting characters and spaces;

setting means for setting an automatic line feed mode;

discriminating means for discriminating if a space input is made in a present hot zone;

automatic line feed means for causing an automatic line feed on the basis of discrimination of a first space input in the hot zone when the automatic line feed mode is set by said setting means;

determining means for determining if a space input has been made immediately after the automatic line feed by said automatic line feed means;

cancelling means for cancelling spaces input subsequent to the first space input in the hot zone so that a space is not produced immediately after completion of an automatic line feed when it is determined by said determining means that a space is input immediately after the automatic line feed; and output means connected to said cancelling means for outputting a character subsequent to the cancelled space inputs at a position of a beginning of a new line after completion of an automatic line feed.

6. Electronic equipment according to claim 5, wherein said input means includes a keyboard.

7. Electronic equipment according to claim 5, further comprising resetting means for resetting a content of aid memory means upon a new character input by said input means.

8. Electronic equipment according to claim 5, wherein said automatic line feed means performs an automatic line feed when a space input is discriminated to be int he hot zone by said discriminating means and when said setting means sets the automatic line feed mode to cause said input means to be operative to input characters and spaces in said new line.

9. Electronic equipment comprising:

input means for inputting characters and spaces;

setting means for setting an automatic line feed mode;

a carriage, having a printing device, for sequentially shifting a printing position of said printing device in accordance with the characters and spaces input through said input means;

discriminating means for discriminating if a space input is made in a present hot zone;

means for automatically line feeding said carriage when said discriminating means discriminates a first space input in said hot zone and when said setting means sets an automatic line feed mode;

determining means for determining if a space input has been made immediately after the automatic line feed by said automatic line feed means;

cancelling means for cancelling spaces input subsequent to the first space input in the hot zone so that a space is not produced immediately after completion of an automatic line feed when it is determined by said determining means that a space is input immediately after the automatic line feed;

output means connected to aid cancelling means for outputting a character subsequent to the cancelled space inputs through said printing device at a position of a beginning of a line after completion of an automatic line feed.

* * * * *

PRINTER'S TRIM LINE

UNITED STATES PATENT AND TRADEMARK OFFICE
CERTIFICATE OF CORRECTION

PATENT NO. : 4,968,163

DATED : November 6, 1990

INVENTOR(S) : Tsutomu Takahashi

It is certified that error appears in the above-identified patent and that said Letters Patent is hereby corrected as shown below:

COLUMN 1:

Line 43, "reason" should read --reason,--.

COLUMN 3:

Line 57, "said new line left margin of" should read --left margin of said new line--.

Line 60, "an" should read --An--.

COLUMN 4:

Line 26, "aid" should read --said--.

Line 32, "int he" should read --in the--.

Line 57, "feed;" should read --feed; and--.

Line 58, "aid" should read --said--.

Signed and Sealed this

Twelfth Day of January, 1993

*Attest:*

DOUGLAS B. COMER

*Attesting Officer*

*Acting Commissioner of Patents and Trademarks*